US008863950B2

(12) United States Patent
Ormsby

(10) Patent No.: US 8,863,950 B2
(45) Date of Patent: Oct. 21, 2014

(54) HANGING DIAPER PAIL

(75) Inventor: Kim Ormsby, Bozeman, MT (US)

(73) Assignee: The Natural Baby Company, LLC, Bozeman, MT (US)

( * ) Notice: Subject to any disclaimer, the term of this patent is extended or adjusted under 35 U.S.C. 154(b) by 294 days.

(21) Appl. No.: 13/617,189

(22) Filed: Sep. 14, 2012

(65) Prior Publication Data

US 2014/0076751 A1 Mar. 20, 2014

(51) Int. Cl.
*A45C 11/00* (2006.01)
*D06F 95/00* (2006.01)

(52) U.S. Cl.
CPC ..... *A45C 11/00* (2013.01); *D06F 95/004* (2013.01)
USPC ..... 206/289; 383/12; 383/43; 383/120; 383/33; 383/41; 383/66; 383/23

(58) Field of Classification Search
USPC ..... 206/289; 383/12, 43, 120, 33, 41, 66, 383/23
See application file for complete search history.

(56) References Cited

U.S. PATENT DOCUMENTS

| | | | | |
|---|---|---|---|---|
| 2,586,974 | A | 2/1952 | Mernon | |
| 2,704,098 | A * | 3/1955 | Pocock | 383/23 |
| 2,740,445 | A | 4/1956 | Fornell | |
| 4,094,351 | A * | 6/1978 | Catenaccio | 224/609 |
| 4,246,945 | A * | 1/1981 | Sterling | 383/43 |
| 4,773,585 | A | 9/1988 | Lehrman | |
| 5,050,998 | A * | 9/1991 | Wachtel | 383/6 |
| 5,370,230 | A * | 12/1994 | Cox | 206/527 |
| 5,503,476 | A * | 4/1996 | Hamdan | 383/9 |
| D387,929 | S | 12/1997 | Stewart | |
| 5,964,533 | A * | 10/1999 | Ziglar | 383/36 |
| 6,328,469 | B1 | 12/2001 | Banco | |
| 6,637,938 | B2 * | 10/2003 | Watkins | 383/23 |
| 7,334,941 | B2 * | 2/2008 | Fenster | 383/117 |
| 7,959,356 | B2 * | 6/2011 | Sommers | 383/16 |
| 2003/0108254 | A1 | 6/2003 | Watkins | |
| 2010/0224515 | A1 | 9/2010 | Siegel et al. | |

* cited by examiner

*Primary Examiner* — Tri Mai
(74) *Attorney, Agent, or Firm* — Antoinette M. Tease

(57) ABSTRACT

A hanging pail comprising a hanger pocket comprising an aperture for a hook portion of a clothes hanger, a mouth portion comprising an arcuate edge, a top half and a bottom half, wherein the top half overlaps the bottom half at a center of the mouth portion, a front body portion comprising a semi-rigid frame that extends around the arcuate edge of the mouth portion, a bottom portion comprising a top edge, a zipper that extends around a portion of the top edge of the bottom portion and connects the bottom portion to the front body portion and the rear body portion, and a connecting portion that connects the bottom portion to the rear body panel when the zipper is fully unzipped.

17 Claims, 10 Drawing Sheets

HANGING DIAPER PAIL

BACKGROUND OF THE INVENTION

1. Field of the Invention

The present invention relates generally to the field of household goods, and more specifically, to a hanging diaper pail.

2. Description of the Related Art

The prior art includes a number of laundry and diaper bags, but none of these inventions possesses the unique structural features of the present invention. U.S. Pat. No. 2,740,445 (Fornell, 1956) provides a clothes hamper that is suspended from the bottom of a clothes chute. There is a slit in the bottom of the bag and a zipper in the slit. The bag is suspended on hooks from the four corners of the top of the bag.

U.S. Pat. No. 4,773,585 (Lehrman, 1988) describes a laundry bag and clothes hamper that is suspended from a removable hanger. The bag includes internal partitions so that laundry can be segregated within the bag. It also comprises a casing with a draw cord that can be used as a conventional laundry bag (i.e., not a hanging bag) when the frame around the open top of the bag is removed.

U.S. Pat. No. 6,328,469 (Banco, 2001) discloses a storage bag with a pocket for a coat hanger. The top of the bag comprises an inverted pocket with a bottom opening for inserting a clothes hanger and a smaller top opening through which the hook of the clothes hanger extends.

U.S. Pat. No. 6,637,938 (Watkins, 2003) provides an apparatus for holding laundry. The laundry apparatus mounts on a door via a mountable rim that is attached to a mounting plate. The mounting plate in turn is either affixed directly to the door or suspended from the top of the door with an over-the-door bracket.

U.S. Pat. No. D387,929 (Stewart, 1997) depicts a hanging closet hamper with an upper pocket for a clothes hanger with an otherwise rectangular shape. The hanging closet hamper has a slim profile and a bottom zipper.

U.S. Patent Application Pub. No. 2010/0224515 (Siegel et al.) describes a combination garment bag, hamper and duffel bag. The invention comprises two sheets of flexible web material that are at least partially sewn together along their peripheral edges. The top end of the invention is closed, and the bottom end of the invention is open. The open bottom end has a closure means, such as a zipper, to prevent clothes from falling out. The closed top end has an aperture for receiving the hook end of a clothes hanger. The invention further comprises a handle strap for carrying the bag (when it is full) to a laundry cleaning facility.

BRIEF SUMMARY OF THE INVENTION

The present invention is a hanging pail comprising: a hanger pocket comprising an aperture for a hook portion of a clothes hanger; a mouth portion comprising an arcuate edge, a top half and a bottom half, wherein the top half overlaps the bottom half at a center of the mouth portion; a front body portion comprising a semi-rigid frame that extends around the arcuate edge of the mouth portion; a bottom portion comprising a top edge; a zipper that extends around a portion of the top edge of the bottom portion and connects the bottom portion to the front body portion and the rear body portion; and a connecting portion that connects the bottom portion to the rear body panel when the zipper is fully unzipped.

In a preferred embodiment, the front body portion comprises a front pleat that begins at a periphery of the mouth portion and ends toward a bottom of the front body portion, and the front portion further comprises two side pleats, each side pleat being situated between the frontal pleat and a seam between the front body portion and the rear body portion. In yet another preferred embodiment, the hanger pocket, the mouth portion, the front body portion, and the bottom portion are all comprised of a fabric impervious to liquid.

In a preferred embodiment, the bottom portion is tapered so that the top edge of the bottom portion is slightly wider than a bottom of the bottom portion. Preferably, the front body portion is tapered so that it is wider at a top of the front body portion than at a bottom of the front body portion. The rear body portion is preferably tapered so that it is wider at a top of the rear body portion than at a bottom of the rear body portion.

In a preferred embodiment, the bottom portion forms a tub when it is unzipped from the front body portion and the rear body portion. In yet another preferred embodiment, the top half of the mouth portion overlaps the bottom half of the mouth portion by a greater degree at a seam between the mouth portion and the hanger pocket than at a center of the arcuate edge of the mouth portion.

In a preferred embodiment, the semi-rigid frame is attached to the front body portion directly underneath a seam between the front body portion and the arcuate edge of the mouth portion. Preferably, the top half of the mouth portion comprises a central edge, the central edge of the top half of the mouth portion comprises a pocket, the pocket extends from a seam between the hanger pocket and the mouth portion to a seam between the arcuate edge of the mouth portion and the front body portion, and a semi-rigid frame is inside of the pocket. The semi-rigid frame inside of the pocket is preferably bowed slightly outward. In a preferred embodiment, the bottom half of the mouth portion comprises a central edge, the central edge of the bottom half of the mouth portion comprises a pocket, the pocket extends from a seam between the hanger pocket and the mouth portion to a seam between the arcuate edge of the mouth portion and the front body portion, and a semi-rigid frame is inside of the pocket. Preferably, the semi-rigid frame inside of the pocket is bowed slightly inward.

In a preferred embodiment, the hanger pocket comprises a front panel and a rear panel, the front panel is attached to the rear panel along a top edge and side edges of the front panel, and the front panel is attached to the mouth portion along a bottom edge of the front panel, the rear panel is attached to the front panel along a top edge and upper portions of side edges of the rear panel, lower portions of the side edges of the rear panel are attached to the front body portion, and a bottom edge of the rear panel extends over the rear body portion and is removably attached to the rear body portion.

In a preferred embodiment, the invention further comprises a ribbon with two ends and a central portion, wherein both ends of the ribbon are attached to a seam between the mouth portion and the front body portion, one end of the ribbon being attached to the seam at a location on the seam that lies above the top half of the mouth portion and is between a central edge of the top half of the mouth portion and a first distal end of the seam, the other end of the ribbon being attached to the seam at a location on the seam that lies above the bottom half of the mouth portion and is between a central edge of the bottom half of the mouth portion and a second distal end of the seam, and wherein the central portion of the ribbon extends around a clothes hanger. In one embodiment, the invention further comprises a ribbon that is attached to the front body portion and that extends around a clothes hanger inserted into the hanger pocket. In another embodiment, the invention further comprises a ribbon that is attached to the mouth portion and that extends around a clothes hanger inserted into the hanger pocket.

REFERENCE NUMBERS

1 Hanger pocket
1*a* Aperture (in hanger pocket)
1*b* Seam (between mouth portion and hanger pocket)
1*c* Front panel (of hanger pocket)
1*d* Rear panel (of hanger pocket)
1*e* Bottom edge (of rear panel of hanger pocket)
2 Mouth portion
2*a* Top half (of mouth portion)
2*b* Bottom half (of mouth portion)
2*c* Arcuate edge (of mouth portion)
2*d* Semi-rigid frame
2*e* Seam (between front body portion and arcuate edge of mouth portion)
2*f* Central edge (of top half of mouth portion)
2*g* Central edge (of bottom half of mouth portion)
2*h* Pocket (in central edge of top half of mouth portion)
2*i* Pocket (in central edge of bottom half of mouth portion)
3 Front body portion
3*a* Frontal pleat
3*b* Side pleat
4 Bottom portion
4*a* Top edge (of bottom portion)
4*b* Bottom (of bottom portion)
5 Zipper
5*a* Connecting portion (between rear body portion and bottom portion)
6 Rear body portion
6*a* Seam (between front body portion and rear body portion)
7 Snap
8 Ribbon

DETAILED DESCRIPTION OF INVENTION

The present invention is a diaper (or dirty clothes) bag that hangs on a hanger. It has an envelope-style, drop-in top that closes back up by itself once the dirty diaper is tossed in. It also has a "bathtub" bottom with a zipper so that one can simply unzip the bottom and let the dirty diapers fall into the wash machine. The unique structural features of the invention are described more fully below.

Figure 1:
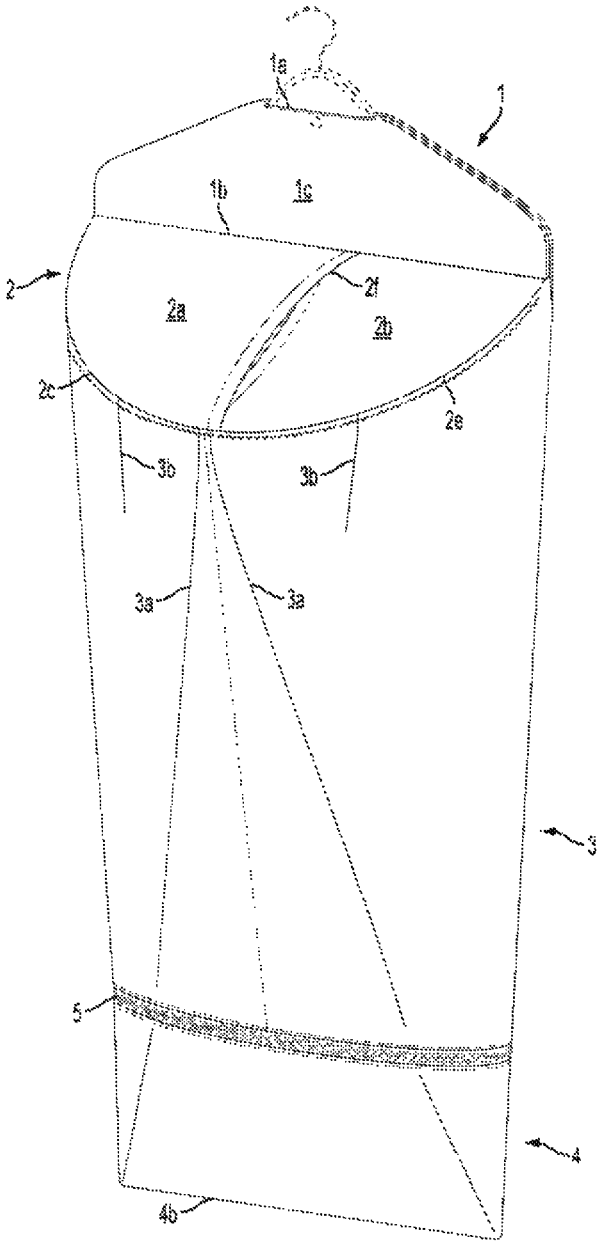
FIG. 1 is a perspective view of the present invention.

FIG. 1 is a perspective view of the present invention. As shown in this figure, the invention comprises a hanger pocket 1, a mouth portion 2 comprising a top half 2*a* and a bottom half 2*b*, a front body portion 3 comprising a frontal pleat 3*a* that begins at the periphery of the mouth portion 2 and ends toward the bottom of the front body portion 3 and two side pleats 3*b* situated between the frontal pleat 3*a* and the seam 6*a* between the front body portion 3 and the rear body portion 6 (see FIG. 3), and a bottom portion 4. In a preferred embodiment, the material comprising the hanger pocket 1, mouth portion 2, front body portion 3 and bottom portion 4 is thermoplastic urethane, which provides both elasticity and resistance to oil, grease and abrasion. In alternate embodiments, this material is any material that is impervious to liquid.

Figure 11A:
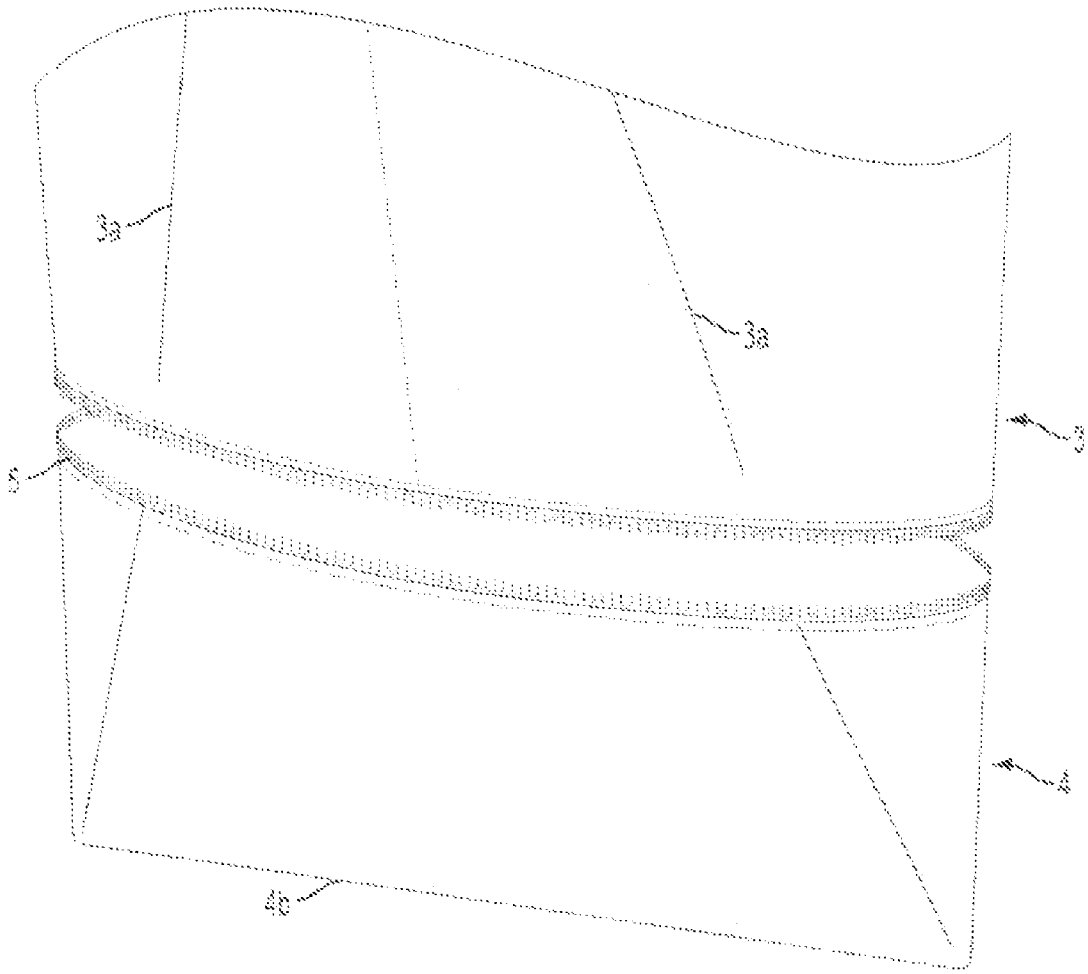
FIG. 11A is a partial front perspective view of the present invention showing the bottom portion unzipped from the front and rear body portions.
Figure 11B:
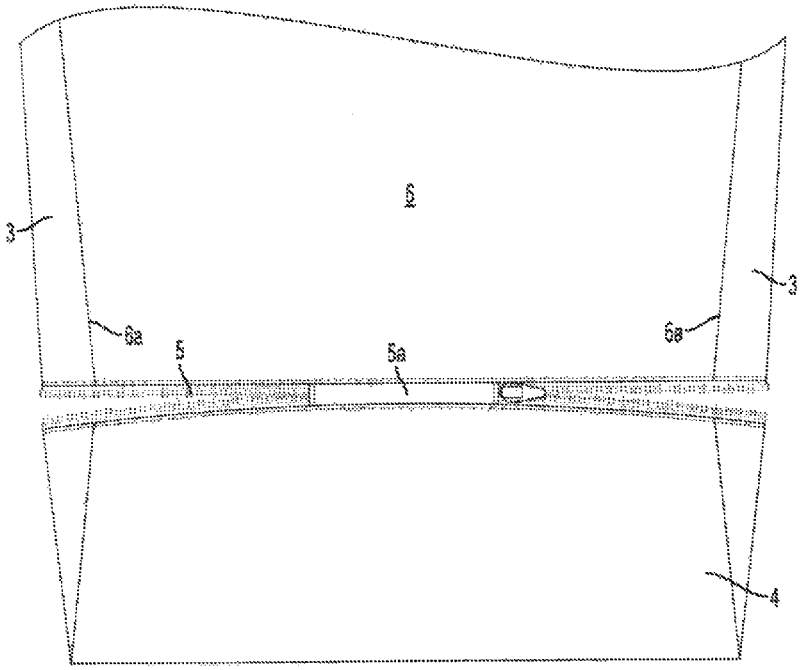
FIG. 11B is a partial rear perspective view of the resent invention showing the bottom portion unzipped from the front and rear body portions.

A zipper 5 extends around the top edge 4*a* of the bottom portion 4 and connects the bottom portion 4 to the front and rear body portions 3, 6. The top edge 4*a* of the bottom portion 4 is preferably slightly wider than the bottom 4*b* of the bottom portion 4 so that the bottom portion 4 is tapered. Similarly, the front and rear body portions 3, 6 are preferably tapered so that they are wider at the top and narrower at the bottom. When unzipped from the front and rear body portion 3, 6, the bottom portion 4 preferably forms a tab (see FIG. 11). The hanger pocket 1 preferably comprises an aperture 1*a* for the hook portion of a clothes hanger.

Figure 2:
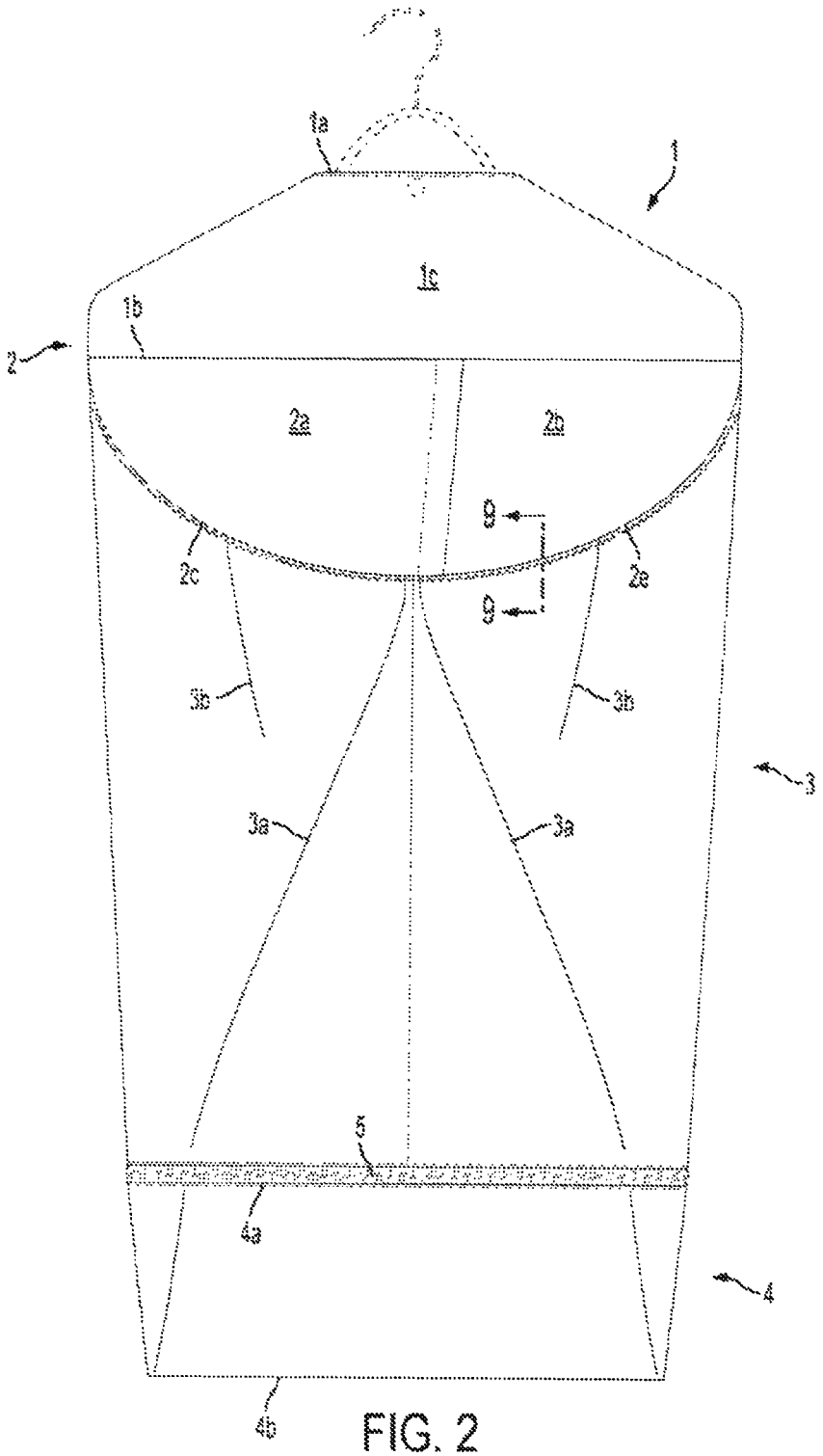
FIG. 2 is a front view of the present invention.

FIG. 2 is a front view of the present invention. As shown in this figure, the top half 2*a* of the mouth portion 2 preferably overlaps the bottom half 2*b* of the mouth portion 2 at the center of the mouth portion 2 (see also FIG. 6). In a preferred embodiment, the top half 2*a* of the mouth portion 2 overlaps the bottom half 2*b* of the mouth portion 2 by approximately two inches at the seam 1*b* between the mouth portion 2 and the hanger pocket 1 and by approximately one inch at the center of the arcuate edge 2*c* of the mouth portion 2. The front body portion preferably comprises a semi-rigid frame 2*d* (see FIGS. 8 and 9) that extends around the entire arcuate edge 2*c* of the mouth portion 2. The semi-rigid frame 2*d* may be comprised of nylon webbing or any other suitable material. In a preferred embodiment, there is a seam 2*e* between the front body portion 3 and the arcuate edge 2*c* of the mouth portion 2, and the semi-rigid frame 2*d* is attached (in a preferred embodiment, sewn or stitched) to the front body portion 3 directly underneath this seam.

Figure 6:
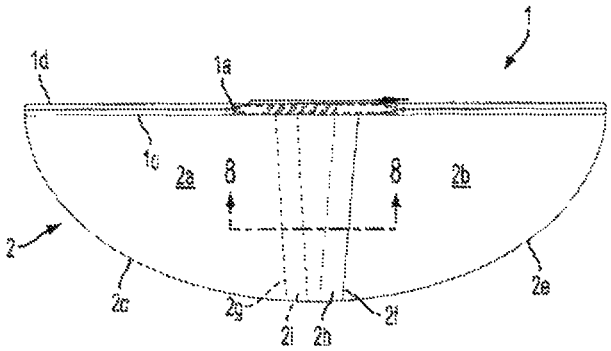
FIG. 6 is a top view of the present invention.

The top half 2*a* of the mouth portion 2 comprises a central edge 2*f*, and the bottom half 2*b* of the mouth portion 2 comprises a central edge 2*g* (see FIG. 6). The central edge 2*f* of the top half 2*a* lies on top of (overlaps) the central edge 2*g* of the bottom half 2*b*. Each of the central edges 2*f*, 2*g* preferably comprises a pocket 2*h*, 2*i* (see FIG. 8) formed by stitching, the pocket 2*h*, 2*i* extending from the seam 1*b* between the hanger pocket 1 and the mouth portion 2 to the seam 2*e* between the arcuate edge 2*c* and the front body portion 3. Inside of each pocket 2*h*, 2*i* is a semi-rigid frame 2*d* (see FIG. 8).

In a preferred embodiment, the semi-rigid frame 2*d* inside pocket 2*h* (on the top half 2*a* of the mouth portion 2) is bowed slightly outward/upward, and the semi-rigid frame 2*d* inside pocket 2*i* (on the bottom half 2*b* of the mouth portion 2) is bowed slightly downward/inward so that an opening is naturally formed between the top and bottom halves 2*a*, 2*b* of the mouth portion 2 (see FIG. 1). The bowing of the semi-rigid frame 2*d* may be accomplished by any number of means, including, but not limited to, making the semi-rigid frame 2*d* slightly longer than the distance between seams 1*b* and 2*e* or twisting the semi-rigid frame 2*d* in a certain direction (to create the desired bias) prior to stitching it down.

Figure 3:
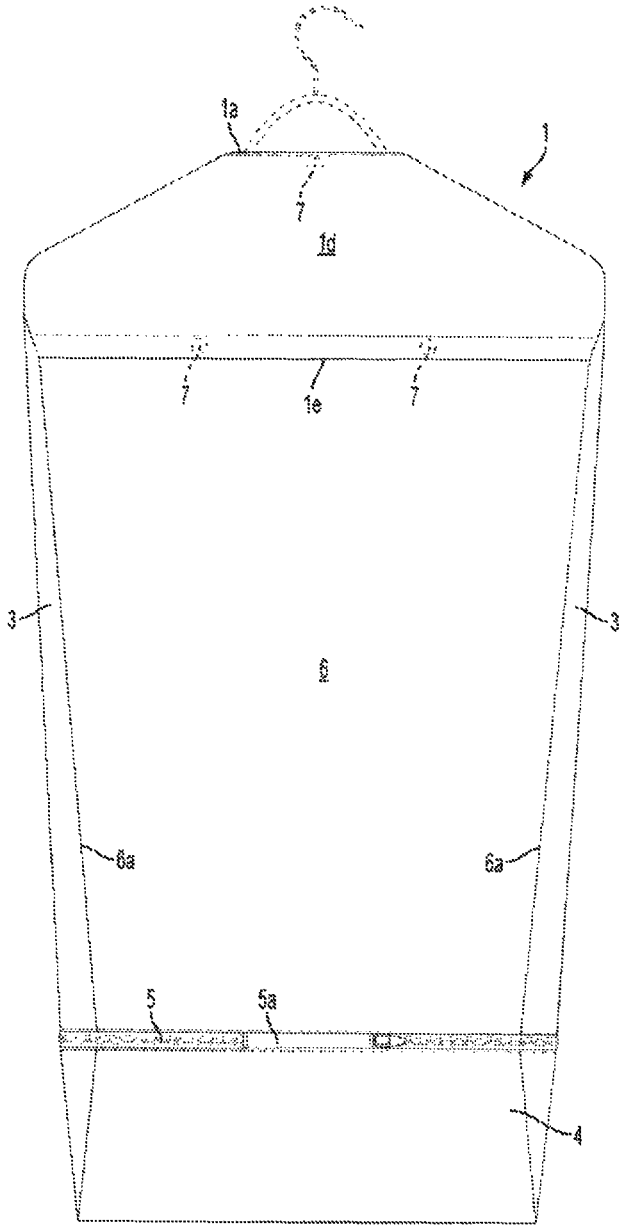
FIG. 3 is a rear view of the present invention.

FIG. 3 is a rear view of the present invention. The hanger pocket 1 preferably comprises a front panel 1*c* (see FIG. 1) and a rear panel 1*d*. The front panel 1*c* of the hanger pocket 1 is sewn (stitched) to the rear panel 1*d* along the top and side edges of the front panel 1*c*, and it is also sewn to the mouth portion 2 along the bottom edge of the front panel 1*c* at seam 1*b* (see FIG. 1). The rear panel 1*d* is sewn to the front panel 1*c* along the top edge and the upper portions of the side edges of the rear panel 1*d*. The lower portions of the side edges of the rear panel 1*d* are stitched to the front body portion 3. The bottom edge 1*e* of the rear panel 1*d* extends over (overlaps) the rear body portion 6 and is removably attached to the rear body portion 6 so that the rear panel 1*d* can be lifted to insert a clothes hanger.

In the embodiment shown, the rear panel 1*d* is attached to the rear body portion 6 with snaps 7, but the present invention is not limited to any particular method of attachment. Other methods of attachment, such as a hook-and-hoop fastener, could be used. In a preferred embodiment, a snap 7 is also located between the front and rear panels 1*c*, 1*d* within the aperture 1*a* to prevent the clothes hanger from falling out of the hanger pocket 1.

As show in FIG. 3, the zipper 5 does not extend across the entire rear body portion 6. There is preferably a connecting portion 5*a* that connects the bottom portion 4 to the rear body panel 6 when the zipper 5 is fully unzipped. In this manner, the bag can be unzipped and dirty diaper (or clothes) dumped out without the bottom portion 4 being completely disengaged from the rest of the invention (see FIGS. 11A and 11B).

Figure 4:
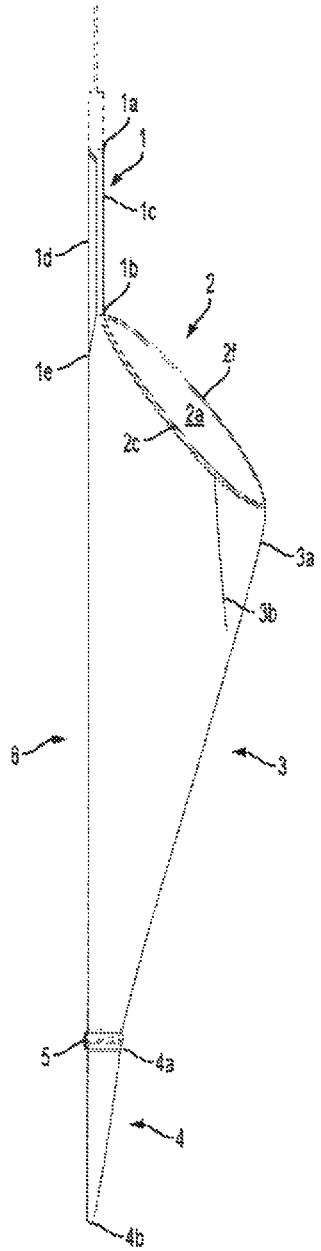
FIG. 4 is a right side view of the present invention.
Figure 5:
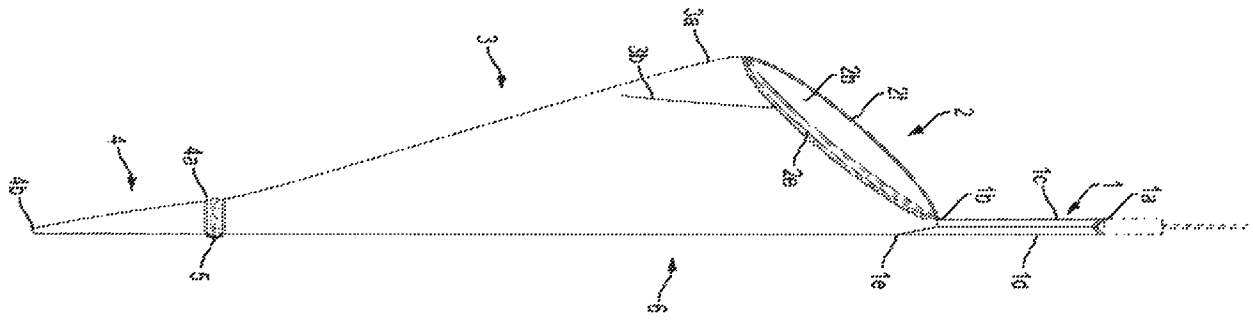
FIG. 5 is a left side view of the present invention.
Figure 7:
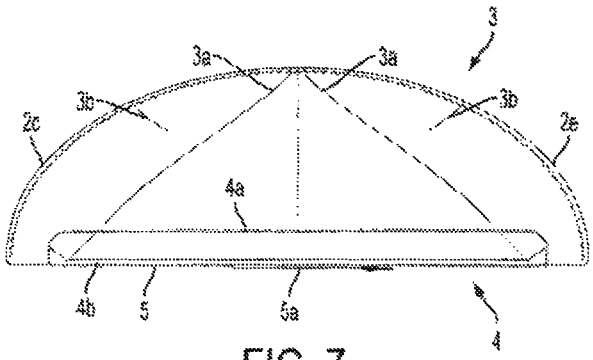
FIG. 7 is a bottom view of the present invention.

FIGS. 4 and 5 are right and left side views, respectively, of the present invention. FIGS. 6 and 7 are top and bottom views, respectively, of the present invention.

Figure 8:
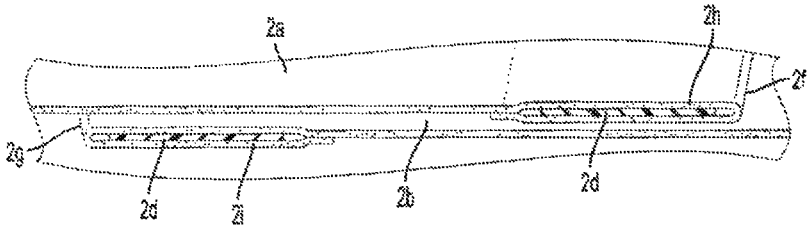
FIG. 8 is a first section view of the semi-rigid frame taken as indicated on FIG. 6.
Figure 9:
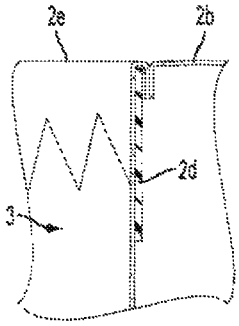
FIG. 9 is a second section view of the semi-rigid frame taken as indicated on FIG. 2.
Figure 10:
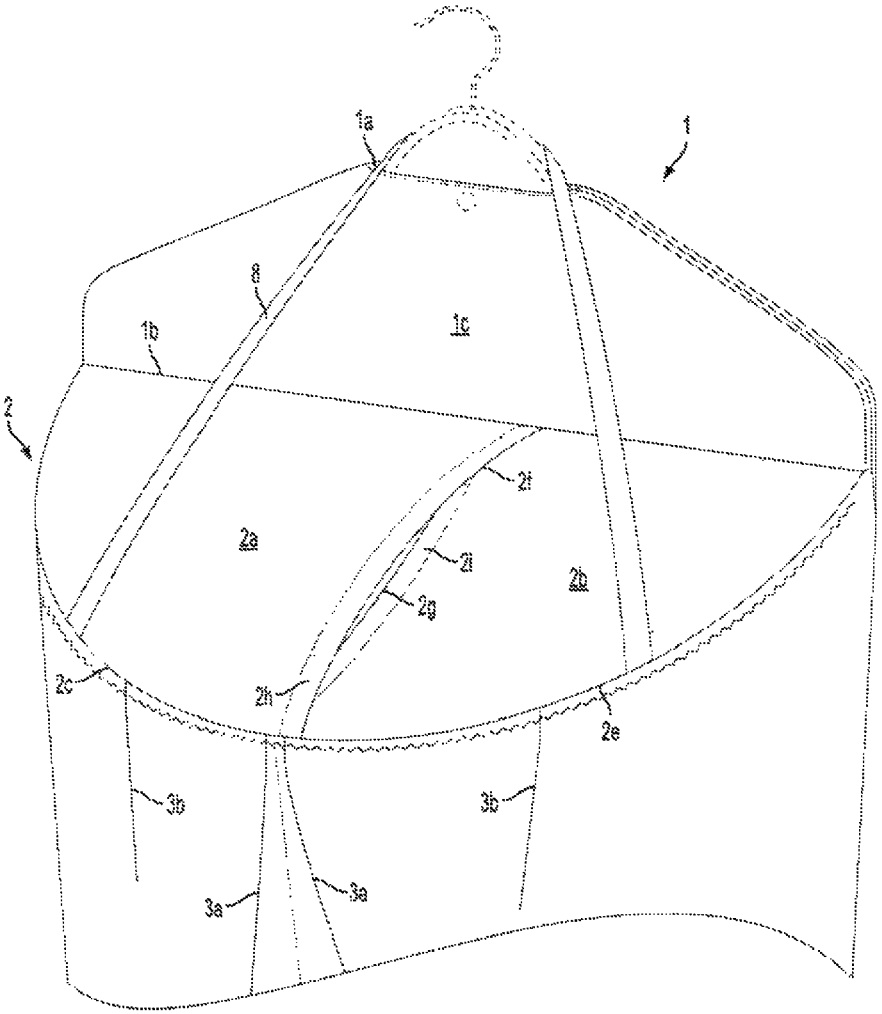
FIG. 10 is a partial perspective view of the present invention showing the optional hanging ribbon.

FIG. 8 is a section view taken as indicated on FIG. 6 and showing the semi-rigid frame that is forms the opening between the top and bottom halves 2*a*, 2*b* of the mouth portion 2. FIG. 9 is a section view taken as indicated on FIG. 2 showing the semi-rigid frame that surrounds the arcuate edge 2*c* of the mouth portion 2. This semi-rigid frame facilitates use of the present invention by maintaining the mouth portion 2 in a semi-upright position (while still being flexible) and providing an opening for the insertion of clothes, diapers or other items.

I claim:

1. A hanging pail comprising:

(a) a hanger pocket comprising an aperture for a hook portion of a clothes hanger;

(b) a mouth portion comprising an arcuate edge, a top half and a bottom half, wherein the top half overlaps the bottom half at a center of the mouth portion;

(c) a front body portion comprising a semi-rigid frame that extends around the arcuate edge of the mouth portion;

(d) a bottom portion comprising a top edge;

(e) a zipper that extends around a portion of the top edge of the bottom portion and connects the bottom portion to the front body portion and the rear body portion; and (f) a connecting portion that connects the bottom portion to the rear body panel when the zipper is fully unzipped.

2. The hanging pail of claim 1, wherein the front body portion comprises a front pleat that begins at a periphery of the mouth portion and ends toward a bottom of the front body portion, and wherein the front portion further comprises two side pleats, each side pleat being situated between the frontal pleat and a seam between the front body portion and the rear body portion.

3. The hanging pail of claim 1, wherein the hanger pocket, the mouth portion, the front body portion, and the bottom portion are all comprised of a fabric impervious to liquid.

4. The hanging pail of claim 1, wherein the bottom portion is tapered so that the top edge of the bottom portion is slightly wider than a bottom of the bottom portion.

5. The hanging pail of claim 1, wherein the front body portion is tapered so that it is wider at a top of the front body portion than at a bottom of the front body portion.

6. The hanging pail of claim 1, wherein the rear body portion is tapered so that it is wider at a top of the rear body portion than at a bottom of the rear body portion.

7. The hanging pail of claim 1, wherein the bottom portion forms a tub when it is unzipped from the front body portion and the rear body portion.

8. The hanging pail of claim 1, wherein the top half of the mouth portion overlaps the bottom half of the mouth portion by a greater degree at a seam between the mouth portion and the hanger pocket than at a center of the arcuate edge of the mouth portion.

9. The hanging pail of claim 1, wherein the semi-rigid frame is attached to the front body portion directly underneath a seam between the front body portion and the arcuate edge of the mouth portion.

10. The hanging pail of claim 1, wherein the top half of the mouth portion comprises a central edge, wherein the central edge of the top half of the mouth portion comprises a pocket, wherein the pocket extends from a seam between the hanger pocket and the mouth portion to a seam between the arcuate edge of the mouth portion and the front body portion, and wherein a semi-rigid frame is inside of the pocket.

11. The hanging pail of claim 10, wherein the semi-rigid frame inside of the pocket is bowed slightly outward.

12. The hanging pail of claim 1, wherein the bottom half of the mouth portion comprises a central edge, wherein the central edge of the bottom half of the mouth portion comprises a pocket, wherein the pocket extends from a seam between the hanger pocket and the mouth portion to a seam between the arcuate edge of the mouth portion and the front body portion, and wherein a semi-rigid frame is inside of the pocket.

13. The hanging pail of claim 12, wherein the semi-rigid frame inside of the pocket is bowed slightly inward.

14. The hanging pail of claim 1, wherein the hanger pocket comprises a front panel and a rear panel, wherein the front panel is attached to the rear panel along a top edge and side edges of the front panel, wherein the front panel is attached to the mouth portion along a bottom edge of the front panel, wherein the rear panel is attached to the front panel along a top edge and upper portions of side edges of the rear panel, wherein lower portions of the side edges of the rear panel are attached to the front body portion, and wherein a bottom edge of the rear panel extends over the rear body portion and is removably attached to the rear body portion.

15. The hanging pail of claim 1, further comprising a ribbon with two ends and a central portion, wherein both ends of the ribbon are attached to a seam between the mouth portion and the front body portion, one end of the ribbon being attached to the seam at a location on the seam that lies above the top half of the mouth portion and is between a central edge of the top half of the mouth portion and a first distal end of the seam, the other end of the ribbon being attached to the seam at a location on the seam that lies above the bottom half of the mouth portion and is between a central edge of the bottom half of the mouth portion and a second distal end of the seam, and wherein the central portion of the ribbon extends around a clothes hanger.

16. The hanging pail of claim 1, further comprising a ribbon that is attached to the front body portion and that extends around a clothes hanger inserted into the hanger pocket.

17. The hanging pail of claim 1, further comprising a ribbon that is attached to the mouth portion and that extends around a clothes hanger inserted into the hanger pocket.

* * * * *